US011725851B2

(12) United States Patent
Ding et al.

(10) Patent No.: US 11,725,851 B2
(45) Date of Patent: Aug. 15, 2023

(54) MULTIPLE STAGE REFRIGERATION SYSTEM AND CONTROL METHOD THEREOF

(71) Applicant: Carrier Corporation, Palm Beach Gardens, FL (US)

(72) Inventors: Haiping Ding, Shanghai (CN); Shaojuan Si, Shanghai (CN); Xiangyuan Zhang, Shanghai (CN); Michael A. Stark, Mooresville, NC (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 285 days.

(21) Appl. No.: 16/497,504

(22) PCT Filed: Mar. 23, 2018

(86) PCT No.: PCT/US2018/024000
§ 371 (c)(1),
(2) Date: Sep. 25, 2019

(87) PCT Pub. No.: WO2018/183107
PCT Pub. Date: Oct. 4, 2018

(65) Prior Publication Data

US 2021/0285692 A1 Sep. 16, 2021

(30) Foreign Application Priority Data

Mar. 31, 2017 (CN) ..... 201710207841.3

(51) Int. Cl.
*F25B 1/10* (2006.01)
*F25B 41/20* (2021.01)
(Continued)

(52) U.S. Cl.
CPC ..... *F25B 1/10* (2013.01); *F25B 5/04* (2013.01); *F25B 41/20* (2021.01); *F25B 41/39* (2021.01);
(Continued)

(58) Field of Classification Search
CPC .... F25B 1/10; F25B 41/20; F25B 5/04; F25B 2400/13; F25B 2500/31; F25B 2600/2501; F25B 2600/2509
See application file for complete search history.

(56) References Cited

U.S. PATENT DOCUMENTS 2,897,659 A 8/1959 Frantisek
4,594,858 A 6/1986 Shaw
(Continued)

FOREIGN PATENT DOCUMENTS

CN 201582913 U 9/2010
CN 201621800 U 11/2010
(Continued)

OTHER PUBLICATIONS

American Heritage Dictionary Entry_ linked (2020) (Year: 2020).*
(Continued)

*Primary Examiner* — Ljiljana V. Ciric
*Assistant Examiner* — Bejeir Brooks
(74) *Attorney, Agent, or Firm* — Cantor Colburn LLP

(57) ABSTRACT

A multi-stage refrigeration system (100) includes: a refrigeration loop (110), which includes a gas suction port of a multi-stage compressor (111), a condenser (112), a first throttling element (113), an evaporator (114) and an exhaust port of the multi-stage compressor which are sequentially connected through pipelines; an economizer branch (120), which includes an economizer (121), a second throttling element (122) and a first control valve (123), the economizer having an economizer liquid inlet connected to the con-
(Continued)

denser via the first throttling element, an economizer liquid outlet connected to the evaporator via the second throttling element, and an economizer exhaust port connected to an intermediate stage of the multi-stage compressor via a control valve; and a bypass branch (130), which is joined to the evaporator from the downstream of the second throttling element and connected to the condenser via the first throttling element, and on which a second control valve (131) is arranged.

9 Claims, 3 Drawing Sheets

(51) Int. Cl.
*F25B 5/04* (2006.01)
*F25B 41/39* (2021.01)

(52) U.S. Cl.
CPC ... *F25B 2400/0411* (2013.01); *F25B 2400/13* (2013.01); *F25B 2500/31* (2013.01); *F25B 2600/2501* (2013.01); *F25B 2600/2509* (2013.01); *F25B 2700/19* (2013.01); *F25B 2700/21* (2013.01)

(56) References Cited

U.S. PATENT DOCUMENTS

| | | | | |
|---|---|---|---|---|
| 4,938,029 | A | 7/1990 | Shaw | |
| 5,095,712 | A | 3/1992 | Narreau | |
| 5,577,390 | A | 11/1996 | Kaido et al. | |
| 5,582,022 | A | 12/1996 | Heinrichs et al. | |
| 5,768,901 | A | 6/1998 | Dormer et al. | |
| 5,775,117 | A | 7/1998 | Shaw | |
| 5,996,364 | A | 12/1999 | Lifson et al. | |
| 6,202,438 | B1 | 3/2001 | Barito | |
| 6,385,981 | B1 | 5/2002 | Vaisman | |
| 6,530,238 | B2 | 3/2003 | Hansen | |
| 6,718,781 | B2 | 4/2004 | Freund et al. | |
| 6,928,828 | B1 | 8/2005 | Taras et al. | |
| 6,973,797 | B2 | 12/2005 | Nemit, Jr. | |
| 7,325,411 | B2 | 2/2008 | Bush | |
| 7,478,539 | B2 | 1/2009 | Shapiro et al. | |
| 7,721,562 | B2 | 5/2010 | Lifson et al. | |
| 7,997,091 | B2 | 8/2011 | Lifson et al. | |
| 9,121,627 | B2 | 9/2015 | Kopko et al. | |
| 2008/0016895 | A1* | 1/2008 | Kim | F24T 50/00 62/260 |
| 2008/0098760 | A1* | 5/2008 | Seefeldt | F25B 1/10 62/238.7 |
| 2010/0251750 | A1 | 10/2010 | Lifson et al. | |
| 2011/0036110 | A1* | 2/2011 | Fujimoto | F24D 17/02 62/238.7 |
| 2011/0138825 | A1* | 6/2011 | Chen | F25B 49/02 62/115 |
| 2012/0000237 | A1* | 1/2012 | Yamada | F25B 1/10 62/324.6 |
| 2012/0073318 | A1 | 3/2012 | Lifson et al. | |
| 2012/0227426 | A1* | 9/2012 | Deaconu | F25B 1/10 62/115 |
| 2015/0316275 | A1* | 11/2015 | Yamashita | F25B 13/00 62/228.1 |
| 2016/0370045 | A1* | 12/2016 | Takenaka | F28D 1/0443 |
| 2017/0241688 | A1* | 8/2017 | Takeichi | F25B 13/00 |

FOREIGN PATENT DOCUMENTS

| | | | | |
|---|---|---|---|---|
| CN | 102042717 | A | 5/2011 | |
| EP | 2770276 | A1 | 8/2014 | |
| EP | 2078178 | B1 | 5/2016 | |
| EP | 2770276 | B1 * | 1/2017 | F25B 41/00 |
| JP | 2001108345 | A | 4/2001 | |
| JP | 2013194999 | A * | 9/2013 | |
| JP | 2013194999 | A | 9/2013 | |
| KR | 20140113077 | A | 9/2013 | |

OTHER PUBLICATIONS

Consumer Reports—Best Refrigerator Temperature to Keep Food Fresh, https://www.consumerreports.org/refrigerators/best-refrigerator-temperature-to-keep-food-fresh-a2285610987/, 2021 (Year: 2021).*
Sarkar, J., & Bhattacharyya, S. (2011). Operating characteristics of transcritical CO2 heat pump for simultaneous water cooling and heating. Archives of Thermodynamics, 33(4), 23. doi:https://doi.org/10.2478/v10173-012-0026-8 (Year: 2011).*
International Search Report and Written Opinion for application PCT/US2018/024000, dated Jul. 16, 2018, 14 pages.
Chinese Office Action for Application No. 201710207841.3; dated Jul. 23, 2021; 8 Pages.

* cited by examiner

MULTIPLE STAGE REFRIGERATION SYSTEM AND CONTROL METHOD THEREOF

TECHNICAL FIELD

The present invention relates to the field of refrigeration, and more particularly, relates to a multi-stage refrigeration system and a control method thereof.

BACKGROUND ART

Currently, multi-stage refrigeration systems have been widely applied due to high refrigeration efficiency. However, the multi-stage refrigeration system has poor adaptability for certain severe working conditions. For example, when the unit has operated under a full load for a long time, the following condition may occur: an outflow water temperature of cooling water at the position of an evaporator is relatively high while an outflow water temperature of cooling water at the position of a condenser is relatively low. Namely, a temperature difference between the outflow water temperature of the condenser and the outflow water temperature of the evaporator is decreased. However, the demand for refrigeration capacity of the system is still very high at this time. Under such conditions of large refrigerant flow and a small pressure difference between the condenser and the evaporator (corresponding to a temperature difference between the condenser and the evaporator), the evaporator extremely tends to be over-dry. At the moment, the pressure and temperature in the evaporator is reduced accordingly, and as a result, a low-temperature warning will be triggered to stop the system's operation.

SUMMARY OF THE INVENTION

The present invention aims to provide a multi-stage refrigeration system applicable to severe working conditions with a small working temperature difference and high cooling capacity demand.

The prevent invention additionally aims to provide a control method for the multi-stage refrigeration system applicable to severe working conditions with a small working temperature difference and high cooling capacity demand.

In order to achieve the objective of the present invention, according to one aspect of the present invention, a multi-stage refrigeration system is provided, including: a refrigeration loop, which includes a gas suction port of a multi-stage compressor, a condenser, a first throttling element, an evaporator and an exhaust port of the multi-stage compressor which are sequentially connected through pipelines; an economizer branch, which includes an economizer, a second throttling element and a first control valve, the economizer having an economizer liquid inlet connected to the condenser via the first throttling element, an economizer liquid outlet connected to the evaporator via the second throttling element, and an economizer exhaust port connected to an intermediate stage of the multi-stage compressor via a control valve; and a bypass branch, which is joined to the evaporator from the downstream of the second throttling element and connected to the condenser via the first throttling element, and on which a second control valve is arranged.

In order to achieve the other objective of the present invention, according to another aspect of the present invention, a control method for the above-mentioned multi-stage refrigeration system is further provided, which includes: a normal mode, in which the economizer branch is switched on, the bypass branch is switched off, and the multi-stage refrigeration system operates in a multi-stage refrigeration mode; and a bypass mode, in which the bypass branch is switched on, the economizer branch is switched off, and the multi-stage refrigeration system operates in a single-stage refrigeration mode.

DETAILED DESCRIPTION

Figure 1:
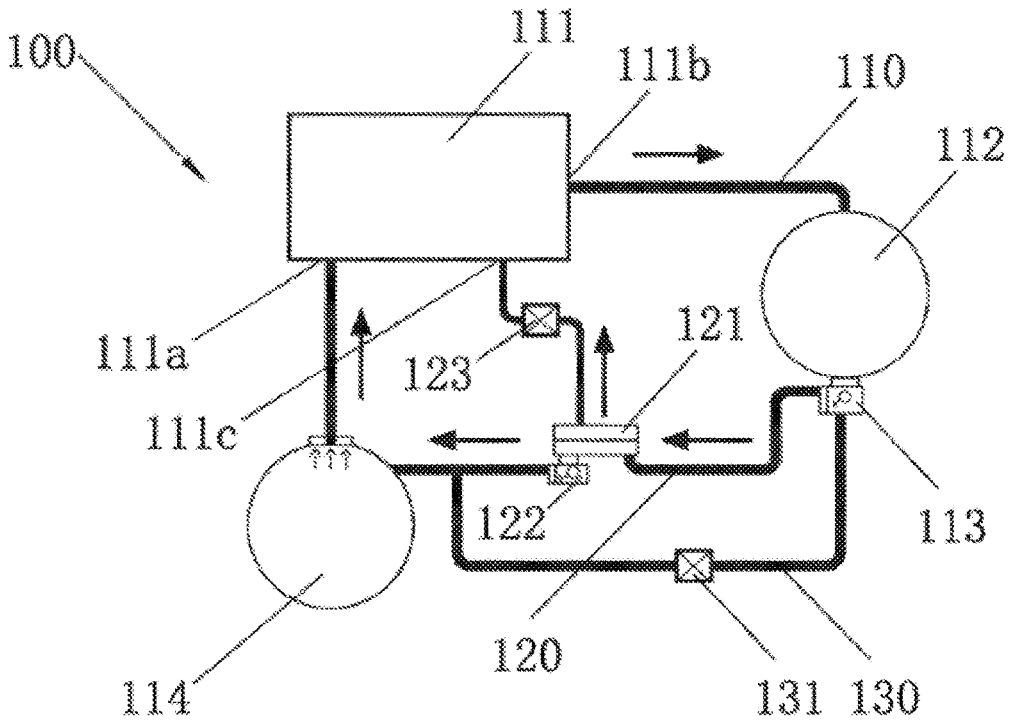
FIG. 1 is a schematic diagram of a system flow passage of a multi-stage refrigeration system of the present invention.

With reference to FIG. 1, it shows one embodiment of a multi-stage refrigeration system 100. The multi-stage refrigeration system 100 includes a refrigeration loop 110, an economizer branch 120 and a bypass branch 130, wherein the refrigeration loop 110 is used for providing a multi-stage refrigeration working cycle in a normal mode; the economizer branch 120 is used for supplementing gas for an intermediate stage of a multi-stage compressor in the normal mode; and the bypass branch 130 is used for providing a single-stage refrigeration working cycle in a bypass mode. The solution thereby provides a multi-stage refrigeration system capable of switching between single-stage refrigeration and multi-stage refrigeration.

Particularly, the refrigeration loop 110 includes an exhaust port 111*b* of the multi-stage compressor 111, a condenser 112, a first throttling element 113, an evaporator 114 and a gas suction port 111*a* of the multi-stage compressor 111 which are sequentially connected through pipelines. The economizer branch 120 includes an economizer 121, a second throttling element 122 and a first control valve 123. The economizer 121 has an economizer 121 liquid inlet connected to the condenser 112 via the first throttling element 113, an economizer 121 liquid outlet connected to the evaporator 114 via the second throttling element 122, and an economizer 121 exhaust port connected to an intermediate stage 111*c* of the multi-stage compressor 111 via a control valve. Moreover, the multi-stage refrigeration system further includes the bypass branch 130, which is joined to the evaporator 114 from the downstream of the second throttling element 122 and connected to the condenser 112 via the first throttling element 113, and on which a second control valve 131 is arranged.

Figure 2:
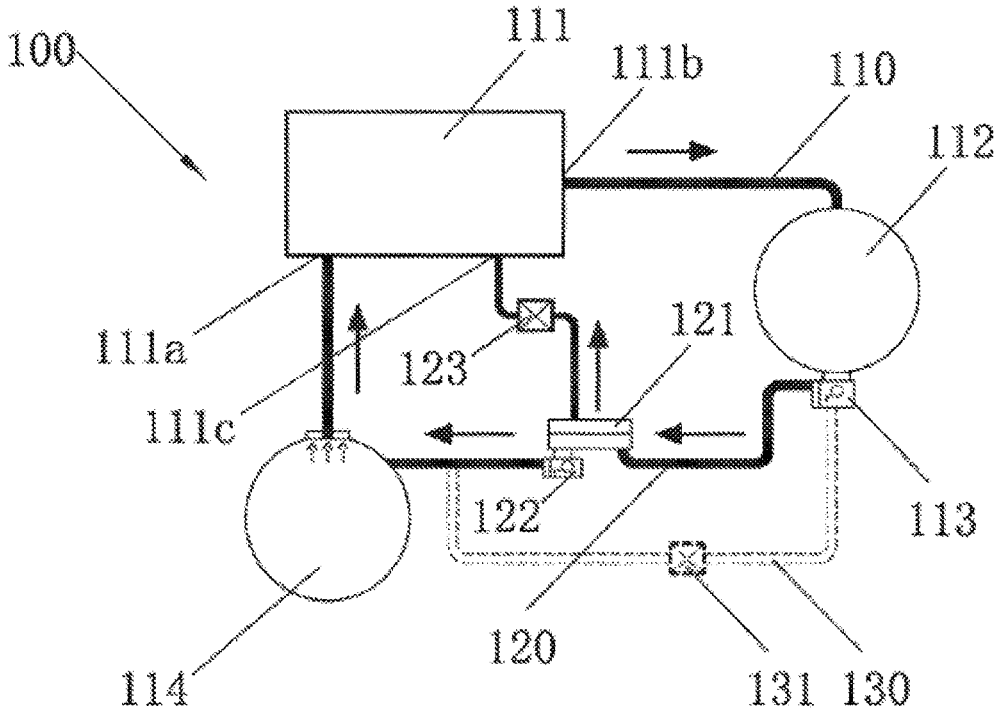
FIG. 2 is a schematic diagram of a system flow passage of the multi-stage refrigeration system of the present invention in a normal mode.

With reference to FIG. 2, under such arrangement, when the system is expected to operate in a multi-stage refrigeration mode under a conventional working condition, the economizer branch 120 can be switched on, and the bypass branch 130 can be switched off. At the moment, a refrigerant, after being compressed via the compressor 111, is discharged via the exhaust port 111*b* of the compressor 111 and flows to the condenser 112 to be condensed and dissipate heat, and then, after being expanded and throttled via the first throttling element 113 at the bottom of the condenser 112, the refrigerant flows to the economizer 121 and is divided into two branches to further participate in the cycle.

Here, a branch of liquid phase refrigerant, after being expanded and throttled via the second throttling element 122, enters the evaporator 114 to be evaporated and absorb heat, and then is sucked into the compressor 111 via the gas suction port 111*a* to participate in a new round of working cycle; and the other branch of gas phase refrigerant flows to the intermediate stage 111*c* of the compressor 111 via the first control valve 123 to supplement gas so as to improve cycle efficiency.

Figure 3:
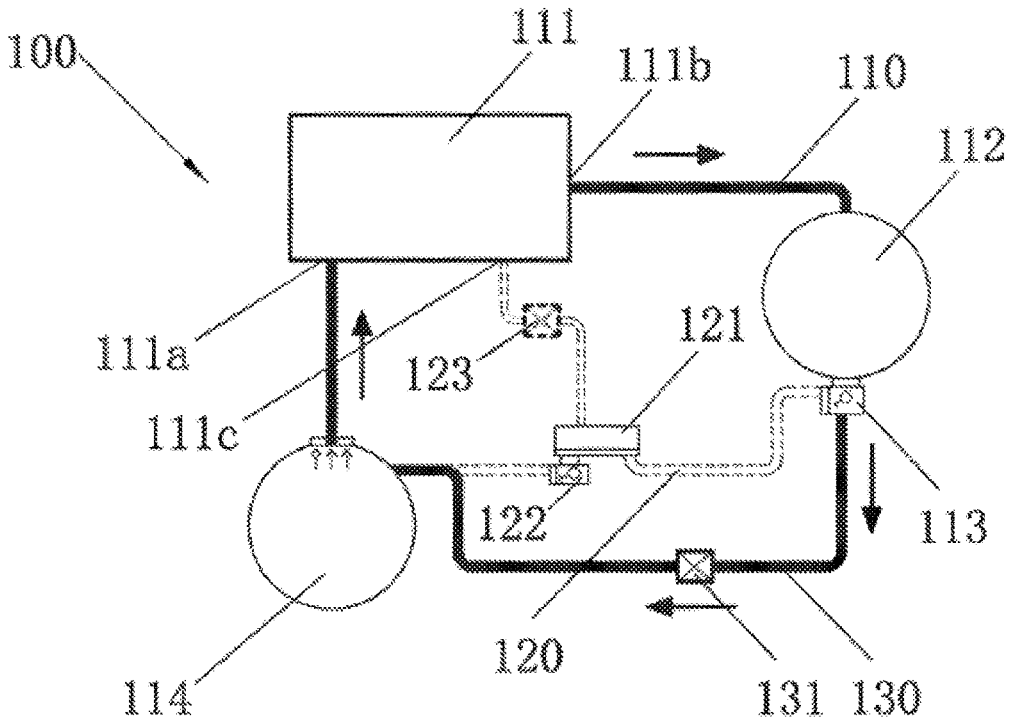
FIG. 3 is a schematic diagram of a system flow passage of the multi-stage refrigeration system of the present invention in a bypass mode.

In addition, under the severe working conditions of a small temperature difference and high cooling capacity, if the normal mode is adopted, an evaporator low-temperature warning condition tends to occur and even the operation of the system is stopped. With reference to FIG. 3, at this time, the bypass branch 130 can be switched on, the economizer branch 120 can be switched off, and the system is switched to operate in a single-stage refrigeration mode. At the moment, the refrigerant, after being compressed via the compressor 111, is discharged via the exhaust port 111*b* of the compressor 111 and flows to the condenser 112 to be condensed and dissipate heat, and then, after being expanded and throttled via the first throttling element 113 at the bottom of the condenser 112, the refrigerant flows to the bypass branch 130 and flows into the evaporator 114 through the second control valve 131 in the bypass branch 130 to be evaporated and absorb heat and then is sucked into the compressor 111 via the gas suction port 111*a* to participate in a new round of working cycle.

The above-mentioned multi-stage refrigeration system not only can efficiently operate in the multi-stage refrigeration mode under the conventional working condition, but also can operate in the single-stage refrigeration mode to solve the problem of a small temperature difference and high cooling capacity demand caused under severe working conditions, thus having higher working adaptability and system stability.

Furthermore, as an optional improvement, the first control valve 123 and the second control valve 131 in the system can be controlled in a linked manner. For example, when the first control valve 123 is controlled to switch on the economizer branch 120, the second control valve 131 can be controlled to switch off the bypass branch 130; and when the first control valve 123 is controlled to switch off the economizer branch 120, the second control valve 131 can be controlled to switch on the bypass branch 130. Start-stop of the control valves and on-off of the flow passage can be either positively correlated or reversely correlated. For example, as one type of examples, the first control valve 123 and/or the second control valve 131 are/is an electric butterfly valve. When a normally-closed electric butterfly valve is started up and powered on, the normally-closed electric butterfly valve is in an open state, and at the moment, the flow passage is switched on; and when a normally-open electric butterfly valve is started up and powered on, the normally-open electric butterfly valve is in a closed state, and at the moment, the flow passage is switched off.

Optionally, there are corresponding judgment standards for switching various working modes. In one embodiment, the judgment standard may be the evaporation temperature, a superheat degree of the compressor or related parameters capable of reflecting those parameters. Therefore, there is also corresponding parameter detection equipment. Part of embodiments of the parameter detection equipment will be provided below for illustration.

For example, the system may include a plurality of temperature sensors, which are respectively used for detecting an evaporation temperature and/or an exhaust temperature of the multi-stage compressor 111 and/or an outflow water temperature of the condenser 112, wherein a difference between the exhaust temperature of the multi-stage compressor 111 and the outflow water temperature of the condenser 112 can be used for reflecting the superheat degree of the system. Certainly, the superheat degree of the system can also be obtained by accurately measuring a pressure and further carrying out conversion, which, however, needs sensors with very high accuracy and will greatly increase material cost. Therefore, in consideration of measurement accuracy and cost, the previously described measurement mode is more preferable in the embodiment.

For another example, the system further includes a plurality of pressure sensors, which are respectively used for detecting an evaporation pressure and/or an exhaust pressure of the multi-stage compressor, wherein the evaporation pressure can reflect the evaporation temperature, and the exhaust pressure can reflect the exhaust temperature.

Moreover, in order to cooperate with an application of the multi-stage refrigeration system in the above-mentioned embodiment, the present invention further provides a control method for the multi-stage refrigeration system. The method at least includes two working modes, i.e., a normal mode, in which the economizer branch 120 is switched on, the bypass branch 130 is switched off, and the multi-stage refrigeration system 100 operates in a multi-stage refrigeration mode; and a bypass mode, in which the bypass branch 130 is switched on, the economizer branch 120 is switched off, and the multi-stage refrigeration system 100 operates in a single-stage refrigeration mode.

The above provides basic control steps of the control method. Particularly, switch-on and switch-off of the flow passage in the control method can be carried out by the control valves arranged in the flow passage. For example, on-off of the economizer branch 120 is controlled by on-off of the first control valve 123; and/or on-off of the bypass branch 130 is controlled by on-off of the second control valve 131. Optionally, in order to simplify the control on a plurality of control valves, on-off of the first control valve 123 and the second control valve 131 can be associated, so that the first control valve 123 and the second control valve 131 can be linked. For example, when the first control valve 123 switches on the economizer branch 120, the second control valve 131 switches off the bypass branch 130; and when the first control valve 123 switches off the economizer branch 120, the second control valve 131 switches on the bypass branch 130.

Moreover, there should be corresponding judgment standards for switching various modes. In one embodiment, the judgment standard may be the evaporation temperature, a superheat degree of the compressor or related parameters capable of reflecting those parameters. Part of embodiments in which the mode switching action is executed by using those parameters as judgment standards will be respectively illustrated below.

For example, when the multi-stage refrigeration system 100 operates in the normal mode, if the evaporation temperature is lower than a first preset temperature, it shows that the evaporator 114 has been in an over-dry state and both the evaporation temperature and the evaporation pressure are very low, and the multi-stage refrigeration system needs to be switched to the bypass mode; and if the evaporation temperature is higher than the first preset temperature, it shows that the evaporation temperature and the evaporation pressure are still in a normal range, and the multi-stage refrigeration system can be kept in the normal mode. Optionally, in order to avoid a misjudgment due to fluctuation of the working condition, a judgment standard in the aspect of time can also be added. For example, when the evaporation temperature is lower than the first preset temperature and this condition has lasted for a first preset period, the multi-stage refrigeration system is switched to the bypass mode. As a specific embodiment, the first preset temperature is in an interval of 1 DEG C to 10 DEG C, and the first preset period is in an interval of 1 minute to 5 minutes. Certainly, it should be known that the parameters in the specific embodiment can be changed according to actual situations.

For another example, when the multi-stage refrigeration system 100 operates in the bypass mode, if a difference between an exhaust temperature of the multi-stage compressor 111 and an outflow water temperature of the condenser 112 is smaller than a first preset temperature difference, it shows that the superheat degree of the system has been normal, and the multi-stage refrigeration system can be switched to the normal mode; and if the difference between the exhaust temperature and the outflow water temperature of the condenser 112 is greater than the first preset temperature difference, it shows that the superheat degree of the system is still excessively high, and thus, the multi-stage refrigeration system still needs to be kept in the bypass mode. Optionally, in order to avoid a misjudgment due to fluctuation of the working condition, the judgment standard in the aspect of time can also be added. For example, when the difference between the exhaust temperature and the outflow water temperature of the condenser is smaller than the first preset temperature difference and this condition has lasted for a second preset period, the multi-stage refrigeration system is switched to the normal mode. As a specific embodiment, the first preset temperature difference is in an interval of 0 DEG C to 6 DEG C, and the second preset period is in an interval of 1 minute to 5 minutes. Certainly, it should be known that the parameters in the specific embodiment can be changed according to actual situations.

For yet another example, when the multi-stage refrigeration system 100 operates in the bypass mode, if the superheat degree of the multi-stage compressor 111 is smaller than a first preset superheat value, it shows that the superheat degree of the system has been normal, and the multi-stage refrigeration system can be switched to the normal mode; and if the superheat degree of the multi-stage compressor 111 is greater than the first preset superheat value, it shows that the superheat degree of the system is still excessively high, and the multi-stage refrigeration system is kept in the bypass mode.

The working process of the multi-stage refrigeration system 100 will be further described below in combination with the above-mentioned embodiments. With reference to FIG. 2, when normally operating, the system is in the normal mode, in which the first control valve 123 is controlled to switch on the economizer branch 120, and the second control valve 131 is controlled to switch off the bypass branch 130. At the moment, the refrigerant, after being compressed via the compressor 111, enters the condenser 112 via the exhaust port 111*b* to be condensed and dissipate heat, and then, after being throttled at the first throttling element 113 for pressure reduction, the refrigerant enters the economizer 121 and is divided into two branches. Then, a branch of gas phase refrigerant enters the intermediate stage 111*c* of the compressor via the first control valve 123 to supplement gas so as to improve efficiency; and the other branch of liquid phase refrigerant, after being throttled via the second throttling element 122 for pressure reduction, enters the evaporator 114 to be evaporated and absorb heat so as to provide cooling capacity for an application environment, and then enters the compressor 111 via the gas suction port 111*a* to start a new round of cycle.

If the system detects that the evaporation temperature is lower than 35 Fahrenheit degrees and this condition has lasted for over 10 seconds, it is determined that the system may be under the severe working conditions of a small temperature difference and high cooling capacity. At the moment, the system should be switched to the bypass mode, in which the second control valve 131 is controlled to switch on the bypass branch 130, and the first control valve 123 is controlled to switch off the economizer branch 120. At the moment, the refrigerant, after being compressed via the compressor 111, enters the condenser 112 via the exhaust port 111*b* to be condensed and dissipate heat, and then after being throttled at the first throttling element 113 for pressure reduction, the refrigerant flows into the bypass branch 130 and flows into the evaporator 114 via the second control valve 131 to be evaporated and absorb heat so as to provide cooling capacity for the application environment, and then enters the compressor 111 via the gas suction port 111*a* to start a new round of cycle.

The examples above mainly illustrate the multi-stage refrigeration system and the control method thereof provided by the present invention. Although only some of embodiments of the present invention are described, those skilled in the art should understand that the present invention may be implemented in various other forms without departure from the purport and the scope of the present invention. Therefore, the illustrated examples and embodiments are exemplary rather than restrictive, and the present invention may cover various modifications and replacements without departure from the spirit and the scope of the present invention defined according to the appended claims.

The invention claimed is:

1. A multi-stage refrigeration system, comprising:

a refrigeration loop, which includes a gas suction port of a multi-stage compressor, a condenser, a first throttling element, an evaporator and an exhaust port of the multi-stage compressor which are sequentially connected through pipelines;

an economizer branch, which includes an economizer, a second throttling element and a first control valve, the economizer having an economizer liquid inlet connected to the condenser via the first throttling element, an economizer liquid outlet connected to the evaporator via the second throttling element, and an economizer exhaust port connected to an intermediate stage of the multi-stage compressor via the first control valve; and a bypass branch, which is joined to the evaporator from the downstream of the second throttling element and connected to the condenser via the first throttling element, and on which a second control valve is arranged;

characterized in that the first control valve and the second control valve are controlled in a linked manner, wherein when the first control valve switches on the economizer branch, the second control valve switches off the bypass branch; and when the first control valve switches off the economizer branch, the second control valve switches on the bypass branch; wherein one of the first control valve and the second control valve is a normally open control valve and the other of the first control valve and the second control valve is a normally closed control valve, wherein upon applying power, the normally open control valve is closed and the normally closed control valve is opened;

a plurality of temperature sensors, which are respectively used for detecting an evaporation temperature and/or an exhaust temperature of the multi-stage compressor and/or an outflow water temperature of the condenser;

wherein the multi-stage refrigeration system is configured to operate in:

a normal mode, in which the economizer branch is switched on, the bypass branch is switched off, and the multi-stage refrigeration system operates in a multi-stage refrigeration mode; and a bypass mode, in which the bypass branch is switched on, the economizer branch is switched off, and the multi-stage refrigeration system operates in a single-stage refrigeration mode;

when the multi-stage refrigeration system operates in the bypass mode, if a difference between an exhaust temperature of the multi-stage compressor and an outflow water temperature of the condenser is smaller than a first preset temperature difference, the multi-stage refrigeration system exists in the normal mode; and if the difference between the exhaust temperature of the multi-stage compressor and the outflow water temperature of the condenser is greater than the first preset temperature difference, the multi-stage refrigeration system exists in the bypass mode.

2. The multi-stage refrigeration system according to claim 1, characterized in that the system further comprises: a plurality of pressure sensors, which are respectively used for detecting an evaporation pressure and/or an exhaust pressure of the multi-stage compressor.

3. The multi-stage refrigeration system according to claim 1, characterized in that the first control valve and/or the second control valve are/is an electric butterfly valve.

4. The multi-stage refrigeration system to claim 1, characterized in that when the multi-stage refrigeration system operates in the normal mode, if an evaporation temperature is lower than a first preset temperature, the multi-stage refrigeration system is switched to the bypass mode; and if the evaporation temperature is higher than the first preset temperature, the multi-stage refrigeration system is kept in the normal mode.

5. The control method according to claim 4, characterized in that when the evaporation temperature is lower than the first preset temperature and this condition has lasted for a first preset period, the multi-stage refrigeration system is switched to the bypass mode.

6. The control method according to claim 5, characterized in that the first preset temperature is in an interval of 1 DEG C to 10 DEG C, and/or the first preset period is in an interval of 1 minute to 5 minutes.

7. The multi-stage refrigeration system according to claim 1, characterized in that when the difference between the exhaust temperature of the multi-stage compressor and the outflow water temperature of the condenser is smaller than the first preset temperature difference and this condition has lasted for a second preset period, the multi-stage refrigeration system is switched to the normal mode.

8. The multi-stage refrigeration system according to claim 7, characterized in that the first preset temperature difference is in an interval of 0 DEG C to 6 DEG C, and/or the second preset period is in an interval of 1 minute to 5 minutes.

9. The multi-stage refrigeration system according to claim 1, characterized in that when the multi-stage refrigeration system operates in the bypass mode, if a superheat degree of the multi-stage compressor is smaller than a first preset superheat value, the multi-stage refrigeration system is switched to the normal mode; and if the superheat degree of the multi-stage compressor is greater than the first preset superheat value, the multi-stage refrigeration system is kept in the bypass mode.

* * * * *